US006991227B2

(12) United States Patent
Kim

(10) Patent No.: US 6,991,227 B2
(45) Date of Patent: Jan. 31, 2006

(54) SHEET FEEDER WITH STOPPER

(75) Inventor: Won-taek Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 252 days.

(21) Appl. No.: 10/282,249

(22) Filed: Oct. 29, 2002

(65) Prior Publication Data

US 2003/0184000 A1 Oct. 2, 2003

(30) Foreign Application Priority Data

Apr. 2, 2002 (KR) ..... 2002-18024

(51) Int. Cl.
*B65H 5/00* (2006.01)

(52) U.S. Cl. ..... 271/10.12; 271/241; 271/245; 271/118; 271/121

(58) Field of Classification Search ..... 271/109, 271/117, 118, 121, 124, 241, 245, 246, 10.11, 271/10.12, 10.13
See application file for complete search history.

(56) References Cited

U.S. PATENT DOCUMENTS 4,556,209 A * 12/1985 Tsubo ..... 271/10.16
4,606,536 A * 8/1986 Ohara ..... 271/118
5,253,861 A * 10/1993 Schmaling ..... 271/213
6,431,541 B2 * 8/2002 Kuo et al. ..... 271/118
6,547,235 B2 * 4/2003 Higaki ..... 271/10.01
6,581,924 B2 * 6/2003 Gaarder et al. ..... 271/114

* cited by examiner

*Primary Examiner*—Patrick Mackey
(74) *Attorney, Agent, or Firm*—Staas & Halsey LLP

(57) ABSTRACT

A sheet feeding apparatus for a printing device includes a pickup roller and a feeding roller picking up sheets loaded on a tray and feeding the sheets into a sheet feeding path, respectively, a rotation member installed on a rotation shaft of the feeding roller to support and rotate the pickup roller at a free end, a relay gear engaging the feeding roller and the pickup roller, a clutch unit selectively transferring a raising force of the rotation shaft to the rotation member, and a stopper installed in the rotation member to be elevated and lowered with respect to the rotation member to block a path between the pickup roller and the feeding roller. Accordingly, since the pickup roller is raised to allow the sheets to be loaded and then lowered after the sheets are loaded on the tray, front ends of the sheets are automatically inserted under the pickup roller. In addition, since the stopper aligns the sheets under the pickup roller when the sheets are pushed toward the feeding roller, the front ends of the sheets are prevented from being crumpled by the feeding roller.

27 Claims, 7 Drawing Sheets

SHEET FEEDER WITH STOPPER

CROSS-REFERENCE TO RELATED APPLICATIONS

This application claims the benefit of Korean Patent Application No. 2002-18024, filed Apr. 2, 2002, in the Korean Intellectual Property office, the disclosure of which is incorporated herein by reference.

BACKGROUND OF THE INVENTION

1. Field of the Invention

The present invention relates to a sheet feeding apparatus, and more particularly, to a sheet feeding apparatus for a printing device to pick up sheets from a tray and deliver the sheets into a printing device sheet by sheet.

2. Description of the Related Art

A printing device 100, such as a copying machine, includes a sheet feeding apparatus having a tray 11 for loading sheets S to be supplied into a printing device 10 and a pickup roller 12 introducing the sheets S on the tray 11 into a sheet feeding path (not shown) of the printing device 10 sheet by sheet as shown in FIGS. 1 and 2. The sheet feeding apparatus is used for feeding both sheets and documents. As an automatic document feeding (ADF) type printing device is known to automatically feed the documents, which are to be duplicated, as well as the sheets onto which images are printed, the sheet feeding apparatus has been applied to the printing device not only feeding the sheets but also feeding the documents.

Referring to FIG. 2, when a motor 13 rotates the pickup roller 12, an uppermost sheet S stacked on the tray 11, which is in contact with the pickup roller 12, is inserted into the printing apparatus 10. The sheet feeding apparatus includes a cover 14 that is closed during a printing process to protect the pickup roller 12 and an inlet of the printing device 10, into which the sheets S are inserted as shown in FIG. 2.

In order to smoothly feed the sheets S into the printing device 10, the pickup roller 12 must hold front ends of the sheets S disposed under the pickup roller 12. When an excessive amount of sheets S is loaded on the tray 11, it is difficult for the pickup roller 12 to hold the sheets S. Therefore, the amount of the sheets S that can be loaded on the tray 11 at one time is limited to about 20 sheets. Consequently, a user has to repeat to load the sheets S on the tray 11 to print a large amount of documents. In addition, according to the constitution of the sheet feeding apparatus as shown in FIGS. 1 and 2, an inclination of the tray 11 is angled as steep as possible toward the pickup roller 12 to smoothly slide the sheets S disposed under the pickup roller 12. However, the constitution of the sheet feeding apparatus increases a height of the printing device 10, so that the printing device 10 occupies a large space. In addition, according to the above constitution of the sheet feeding apparatus, more than two sheets may slide under the pickup roller 12, which is referred to as double feeding of the sheets S.

SUMMARY OF THE INVENTION

To solve the above and other problems, it is an object of the present invention to provide an improved sheet feeding apparatus for a printing device to prevent double feeding of sheets and increase an amount of the sheets that can be loaded on a tray.

Additional objects and advantageous of the invention will be set forth in part in the description which follows and, in part, will be obvious from the description, or may be learned by practice of the invention.

To accomplish the above and other objects of the present invention, a sheet feeding apparatus for a printing device includes a pickup roller picking up sheets loaded on a tray to feed the sheets into a sheet feeding path, a feeding roller receiving the sheets picked up by the pickup roller to introduce the sheets into the sheet feeding path, a rotation member installed on a rotation shaft of the feeding roller to support and rotate the pickup roller at a free end of the rotation member, and a relay gear installed in the rotation member to engage the feeding roller and the pickup roller.

According to an aspect of the present invention, the sheet feeding apparatus includes a clutch unit selectively transferring a rotation force of the rotation shaft to the rotation member by blocking the rotation force between the rotation member and the rotation shaft so the pickup roller contacts a sheet on the tray by a weight of the pickup roller when the rotation shaft rotates in a sheet feeding direction and by connecting the rotation force between the rotation shaft and the rotation member to rotate the rotation member according to a rotation of the rotation shaft when the rotation shaft rotates in an opposite direction.

According to another aspect of the present invention, the sheet feeding apparatus includes a stopper installed in the rotation member to be elevated and lowered with respect to the rotation member according to the rotation of the rotation member so as to locate front ends of the sheets loaded on the tray to be disposed under the pickup roller while not reaching the feeding roller because the stopper blocks a path between the pickup roller and the feeding roller.

BRIEF DESCRIPTION OF THE DRAWINGS

The above and other objects and advantages of the present invention will become more apparent an embodiment thereof with reference to the attached drawings, in] and more readily appreciated from the following description of the preferred embodiment, taken in conjunction with the accompanying drawings of which.

DETAILED DESCRIPTION OF THE PREFERRED EMBODIMENTS

Figure 1:
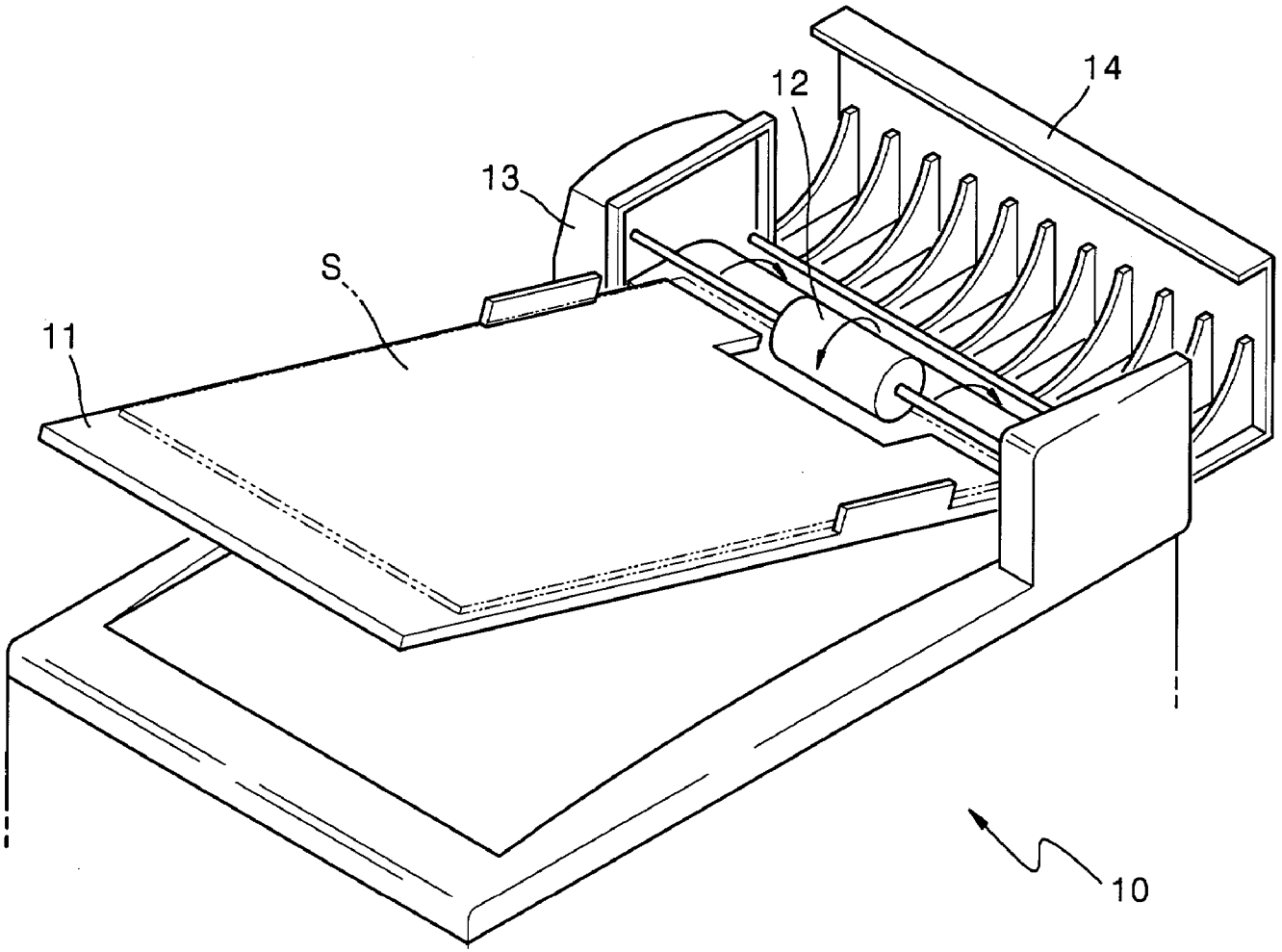
FIG. 1 (PRIOR ART)
FIG. 1 is a perspective view illustrating a printing device containing a conventional sheet feeding apparatus.
Figure 2:
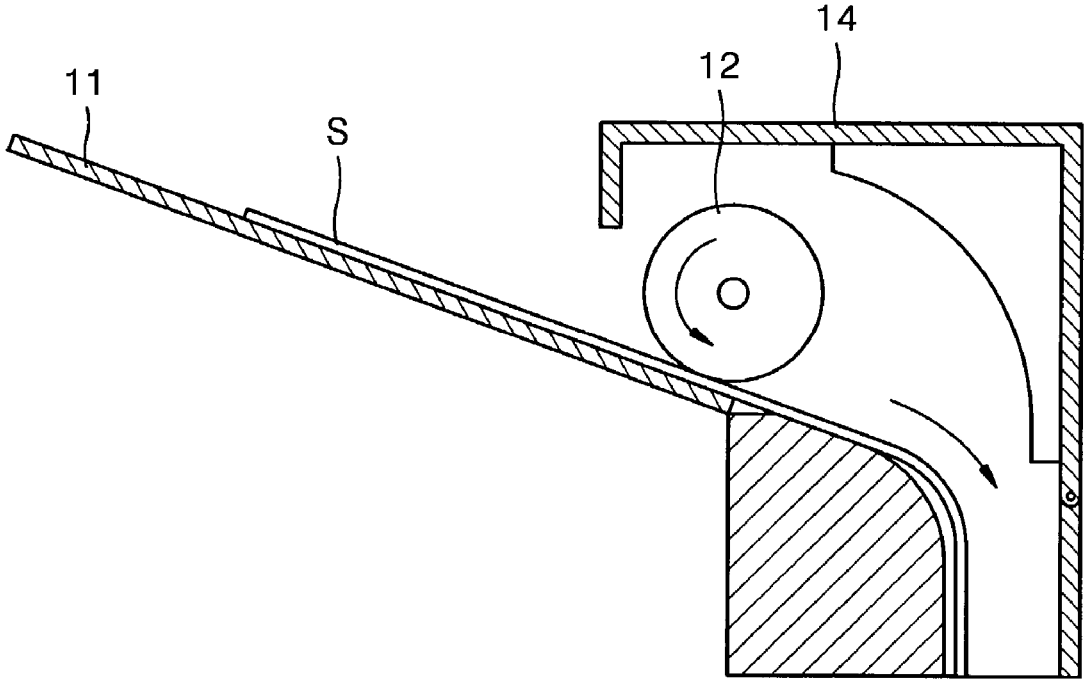
FIG. 2 (PRIOR ART)
FIG. 2 is a view for explaining a sheet feeding process according to the conventional sheet feeding apparatus shown in FIG. 1.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

FIGS. 3 through 8 illustrate a sheet feeding apparatus for a printing device according to an embodiment of the present invention.

Figure 3:
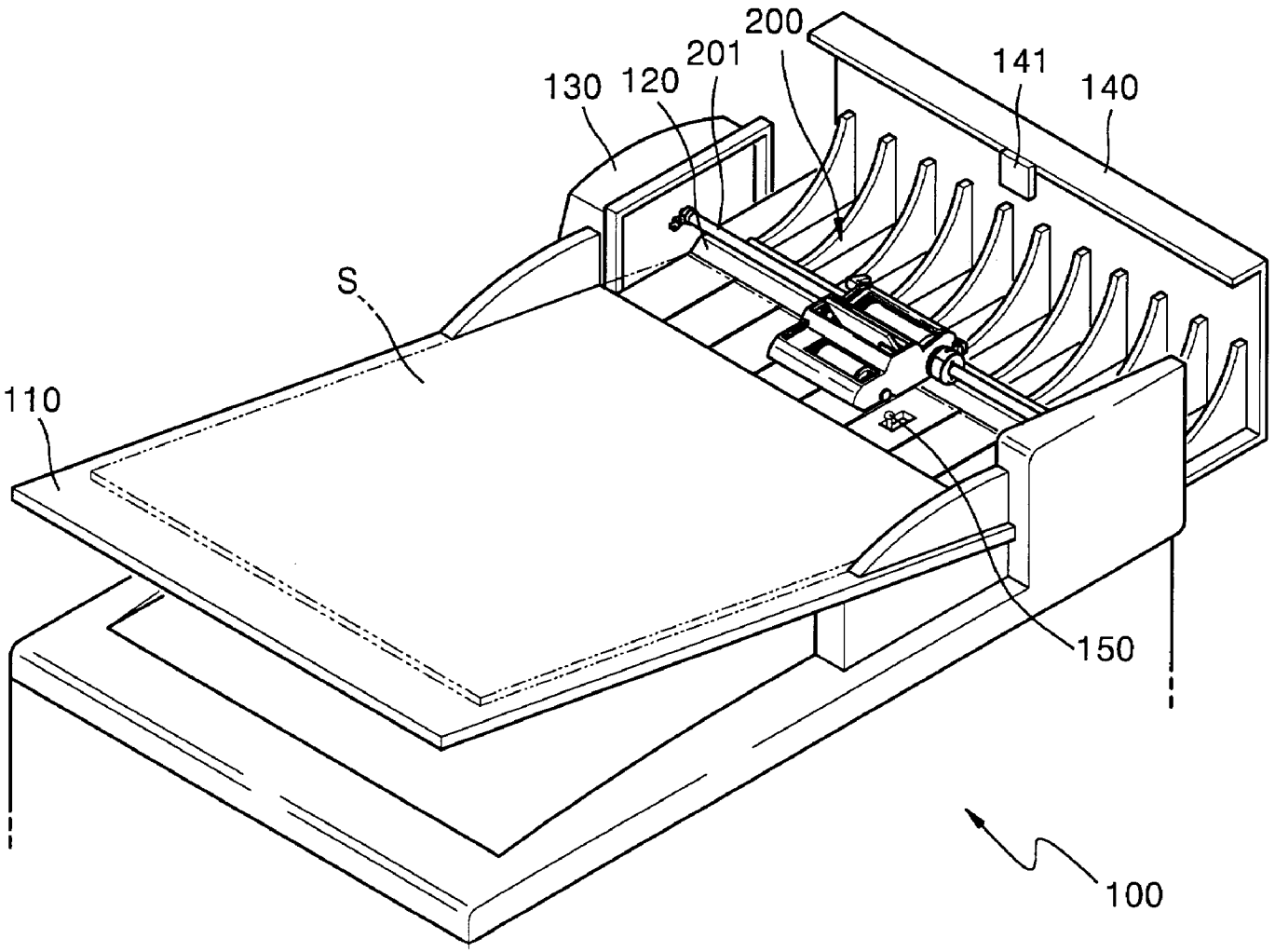
FIG. 3 is a perspective view illustrating a printing device containing a sheet feeding apparatus according to an embodiment of the present invention.

With reference to FIG. 3, a printing device 100 includes a tray 110 on which sheets S are loaded, and a sheet feeding apparatus 200 driven by a driving source 130 to introduce the sheets S into a sheet feeding path in the printing device 100. The printing device 100 further includes a cover 140 that covers the sheet feeding apparatus 200 while the sheet feeding apparatus 200 is in use.

Figure 4:
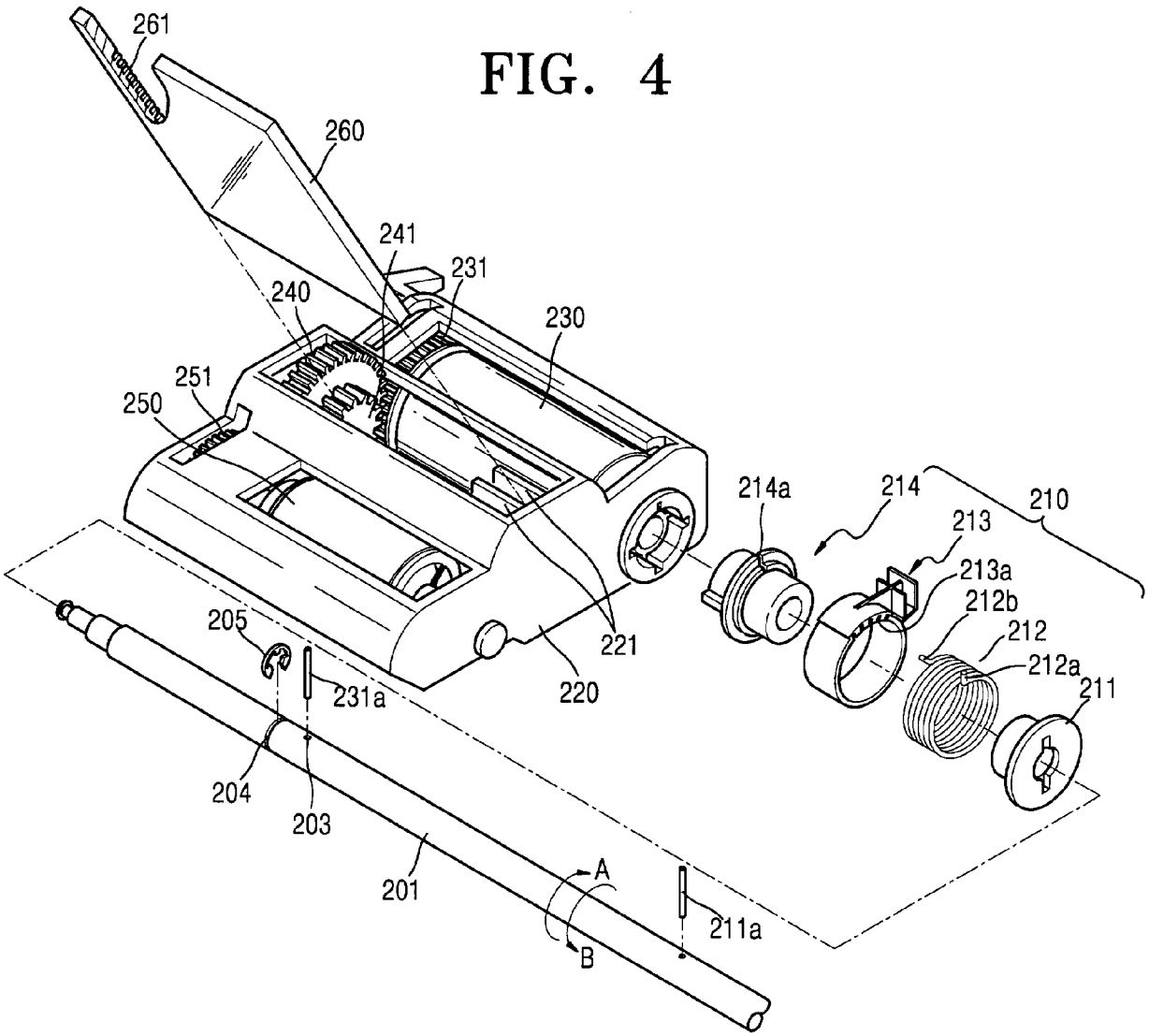
FIG. 4 is an exploded perspective view of the sheet feeding apparatus shown in FIG. 3.

Referring to FIGS. 3 and 4, the sheet feeding apparatus 200 includes a shaft 201 connected to the driving source 130, a feeding roller 230 coaxially installed with the shaft 201, a rotation member 220 rotating about a longitudinal center of the shaft 201, a pickup roller 250 installed at a free end of the rotation member 220 so that the pickup roller 250 may rotate, and a stopper 260 engaged with a relay gear 240 to be elevated and lowered with respect to the rotation member 220. In this case, the relay gear 240 connects the feeding roller 230 to the pickup roller 250. In addition, in a case where the rotation member 220 does not receive a raising force for raising the pickup roller 250 in an upward direction with respect to the longitudinal center of the shaft 201, the rotation member 220 rotates in a downward direction for the pickup roller 250 to contact the sheet S on the tray 110 by its own weight.

The sheet feeding apparatus 200 includes a clutch unit 210 selectively raising the rotation member 220 according to a rotating direction of the shaft 201. When the shaft 201 rotates in a sheet feeding direction of the pickup roller 250, such as a direction for introducing the sheets S into the sheet feeding path in the printing device 100, the raising force between the shaft 201 and the rotation member 220 is disconnected to lower the rotation member 220 in the downward direction by its own weight. When the shaft 201 rotates in an opposite direction opposite to the sheet feeding direction, the raising force of the shaft 201 is connected to the rotation member 220 to raise the rotation member 220 in the upward direction according to the rotation of the shaft 201. With reference to FIG. 4, the clutch unit 210 includes a coupling member 214 coupled on the shaft 201 of the rotation member 220, a bushing 213 into which an external circumference of the coupling member 214 is inserted, a spring clutch 212 having both ends 212*b* and 212*a* respectively coupled to coupling grooves 213*a* and 214*a* of the bushing 213 and the coupling member 214, and a driving member 211 fixed on the shaft 201 by a first fixing pin 211*a* while frictionally contacting an inner circumference of the spring clutch 212.

The inner circumference of the spring clutch 212 contacts the driving member 211, and an external circumference of the spring clutch 212 contacts an inner circumference of the bushing 213. Therefore, when the shaft 201 rotates in a direction of an arrow A, the driving member 211 rotates by a friction in the same direction to rotate the spring clutch 212 in a direction of winding the spring clutch 212 upward. Accordingly, the driving member 211, the spring clutch 212, and the bushing 213 rotate simultaneously by the friction among these components to rotate the coupling member 214, which is connected to the bushing 213 via the ends 212*a* and 212*b* of the spring clutch 212. As a result, the rotation member 220 rotates in the upward direction or in the direction of the arrow A. In this case, the rotation member 220 rotates in the upward direction so that the pickup roller 250 is raised from the tray 110. Although the shaft 201 stops rotating, the pickup roller 250 continues to be raised as long as the friction among the driving member 211, the spring clutch 212, and the bushing 213 is maintained.

When the shaft 201 rotates in a direction of an arrow B, which is opposite to the direction of the arrow A, the driving member 211 rotates in the same direction of the arrow B, in which the spring clutch 212 is unwound. Accordingly, the friction between the driving member 211 and the spring clutch 212 to raise the rotation member 220 is released to return the spring clutch 212, the bushing 213, the coupling member 214, and the rotation member 220 to original positions by the weight of the rotation member 220. Therefore, the pickup roller 250 contacts the sheet S on the tray 110. In a case where the shaft 201 continues to rotate in the direction of the arrow B, the feeding roller 230 and the pickup roller 250 rotate to introduce the sheet S into the sheet feeding path.

Figure 5:
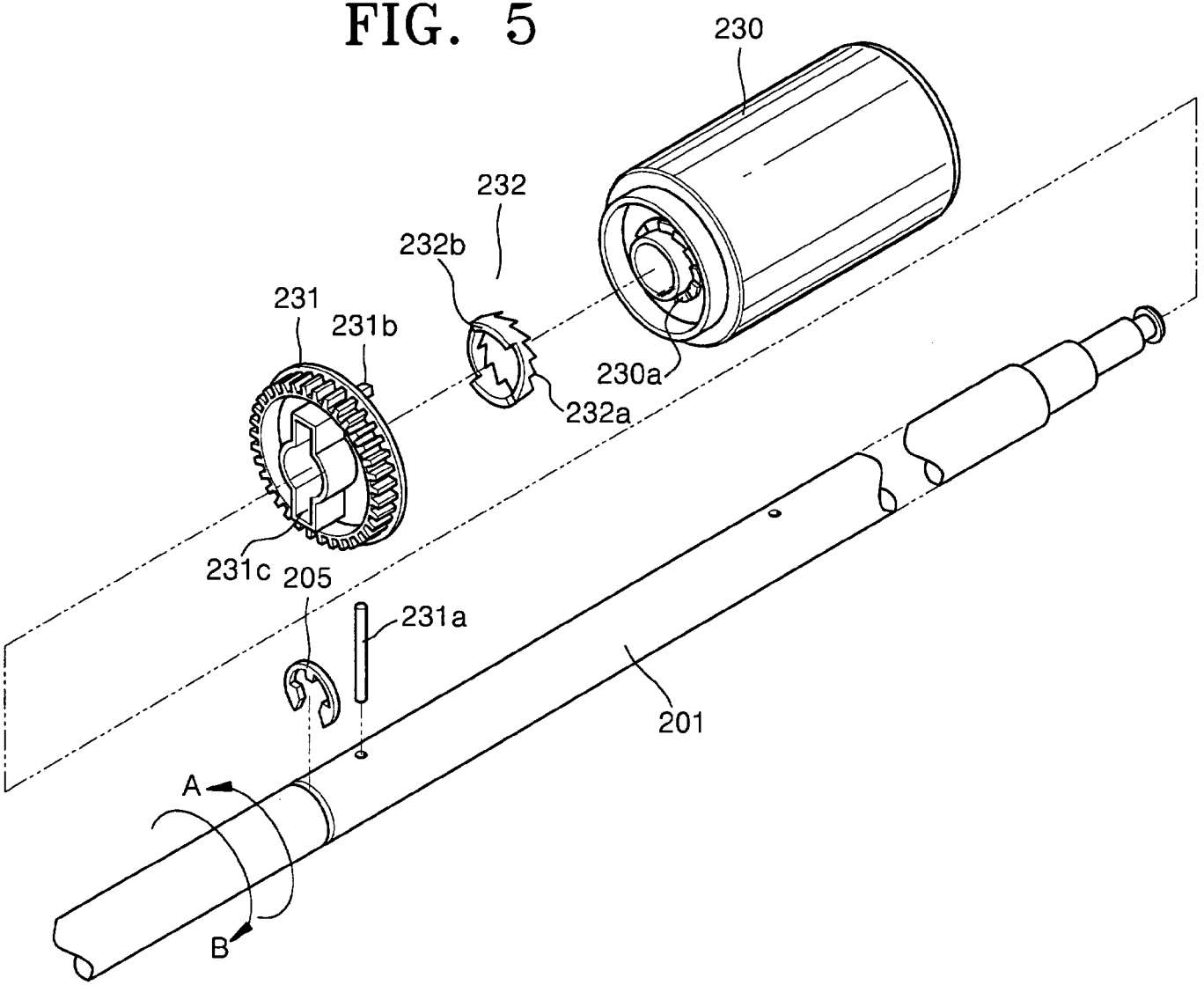
FIG. 5 is an exploded perspective view of a driving force connection unit of a feeding roller in the sheet feeding apparatus shown in FIG. 3.

FIG. 5 illustrates a connection unit transmitting a driving force between the feeding roller 230 and the shaft 201 to selectively rotate the feeding roller 230. As shown in FIG. 5, a gear portion 231, which is connected to the pickup roller 250 by the relay gear 240, contains a slot 231*c* to which a second fixing pin 231*a* is coupled. The second fixing pin 231*a* is inserted into a coupling hole 203 formed in the shaft 201 and then coupled to the slot 231*c* of the gear portion 231. Therefore, the shaft 201 rotates together with the gear portion 231. An end of the feeding roller 230 contains a step surface 230*a* of a pinwheel shape, and a saw tooth member 232 with saw tooth portions 232*a* is installed between the step surface 230*a* and the gear portion 231. Accordingly, the saw tooth portions 232*a* engages with the step surface 230*a*.

The saw tooth member 232 also contains interference pieces 232*b*, and the gear portion 231 contains interference projections 231*b*, which interfere with the interference pieces 232*b*. Consequently, when the gear portion 231 rotates, the interference projections 231*b* engage with the interference pieces 232*b* to rotate the saw tooth member 232. According to the above constitution, when the shaft 201 rotates in the direction of the arrow B to rotate the gear portion 231 and the saw tooth member 232 in the same direction, vertical sections of the saw tooth portion 232*a* are coupled to the vertical sections of the step surface 230*a*. As a result, the feeding roller 230 rotates with the shaft 201 in the same direction.

In contrast, when the shaft 201 rotates in the direction of the arrow A, first inclined sections of the saw tooth portion 232*a* slip off second inclined sections of the step surface 230*a* so as not to rotate the feeding roller 230. As a result, when the shaft 201 rotates in the direction of the arrow A, the rotation member 220 rotates in the upward direction while the feeding roller 230 stops, and when the shaft 201 rotates in the direction of the arrow B, the rotation member 220 is lowered in the downward direction to allow the pickup roller 250 to contact the sheet S, and the feeding roller 230 rotates in the sheet feeding direction for feeding the sheets S.

Meanwhile, the pickup roller 250 does not require the above-described constitution, such as the connection unit, because the pickup roller 250 rotates by a gear connection with the feeding roller 230. However, in order to firmly control a rotating direction of the pickup roller 250, the pickup roller 250 may contain a unit transmitting the driving force between the gear portion 231 of the feeding roller 230 and a pickup gear 251 of the pickup roller 250 as described above, thereby the pickup roller 250 rotates only when the shaft 201 rotates in the direction of the arrow B.

Figure 7:
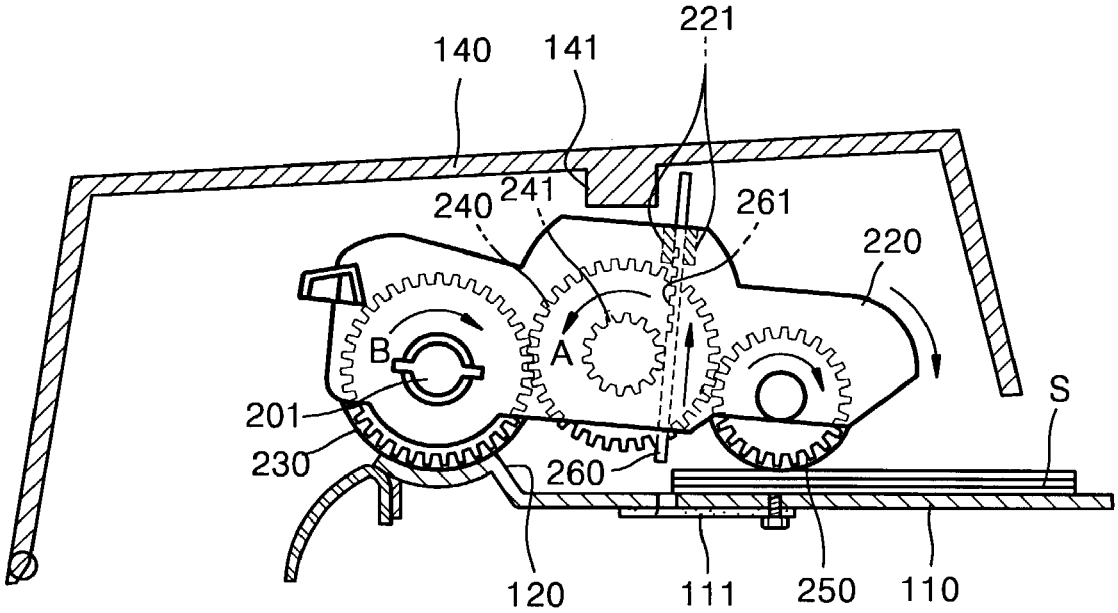
FIGS. 7 and 8 are views explaining an operation of the sheet feeding apparatus shown in FIG. 3.
Figure 8:
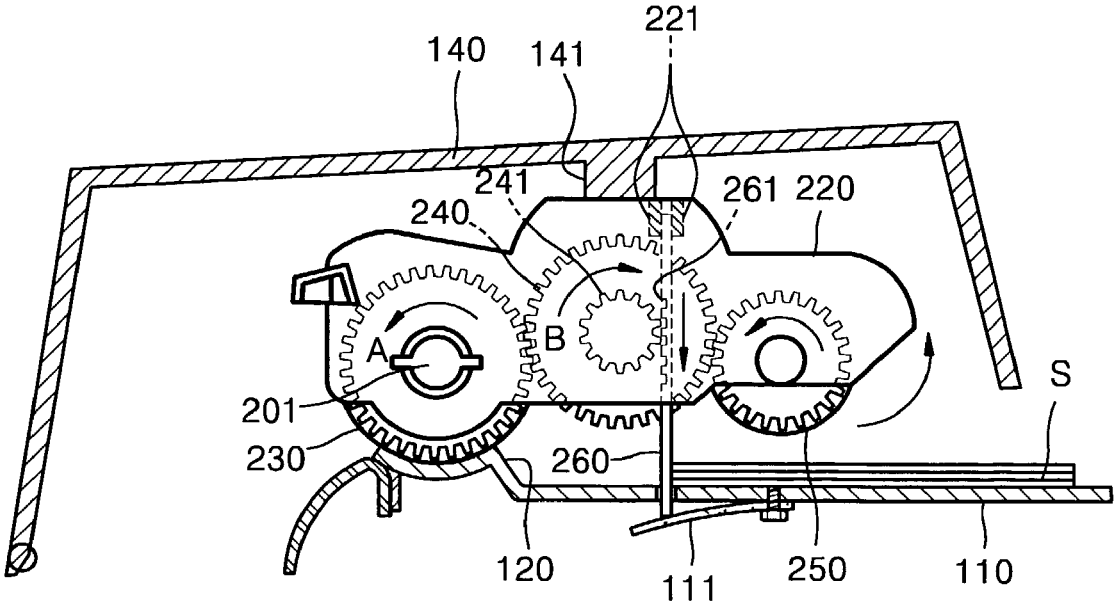

Referring to FIG. 4, the stopper 260 with a rack gear portion 261 at an edge, coupled to an inner gear 241 of the relay gear 240, is elevated and lowered with respect to the rotation member 220 according to a rotation of the relay gear 240. With reference to FIG. 8, the stopper 260 is lowered to prevent the front ends of the sheets S on the tray 110 from reaching the feeding roller 230. Accordingly, the stopper 260 prevents the front ends of the sheets S on the tray 110 from hitting the feeding roller 230 when an excessive force is applied to the pickup roller by a large amount of sheets S disposed under the pickup roller 250. Consequently, the stopper 260 prevents the front ends of the sheets S from being crumpled. In other words, since the stopper 260 aligns the sheets S under the pickup roller 250, one of the sheets S disposed on an upper portion of a stack of the sheets S is prevented from hitting the pickup roller 250 and being pushed back by the user before a printing operation. When the printing operation starts, the stopper 260 elevates as shown in FIG. 7 to introduce the sheet S into the sheet feeding path through the feeding roller 230. The sheet feeding apparatus 200 includes an elastic member that is installed on the tray 110 to apply an elastic force upward to the stopper 260 when the stopper 260 is lowered to push down the elastic member 111.

Figure 6:
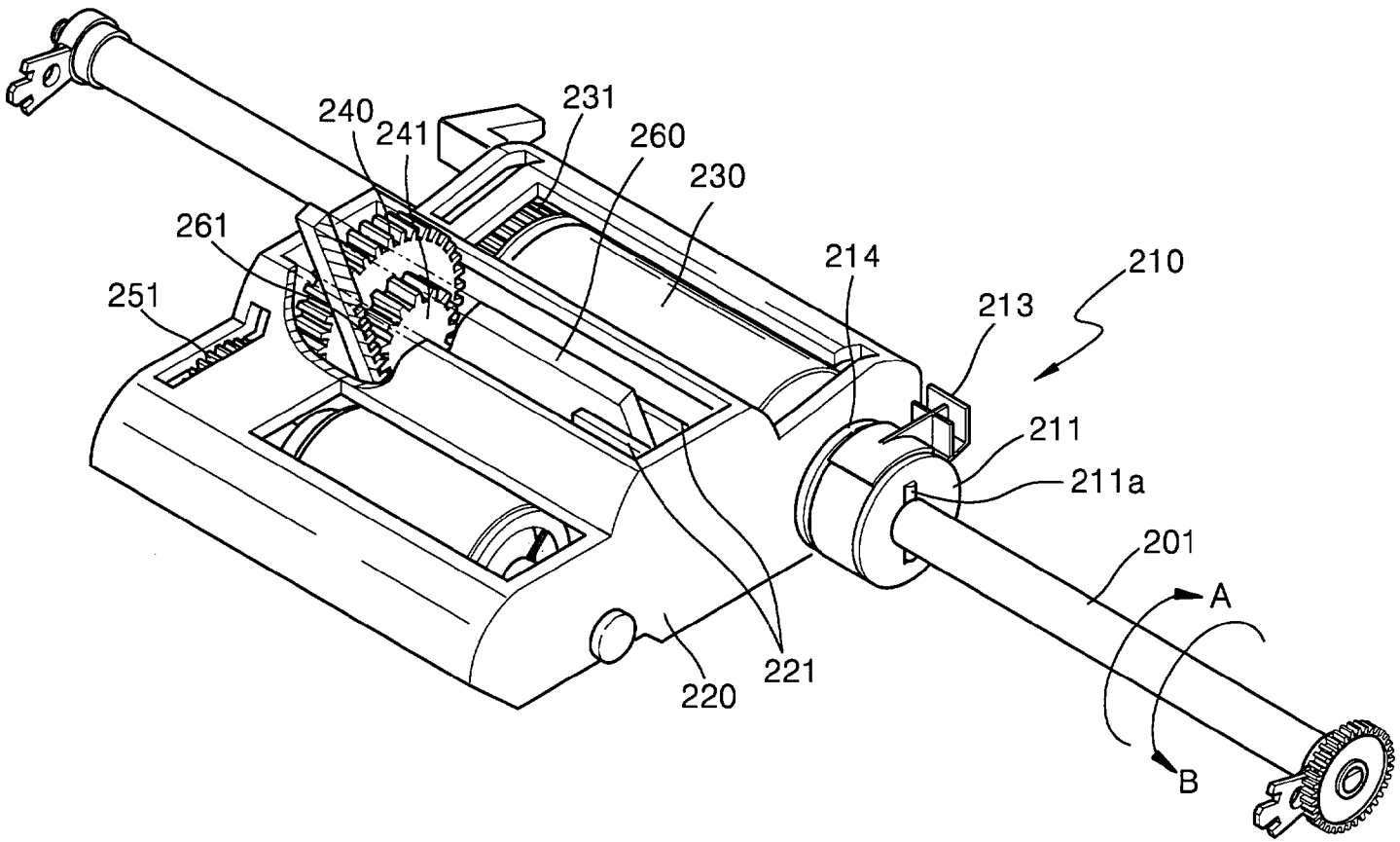
FIG. 6 is a perspective view of combined components of the sheet feeding apparatus shown in FIGS. 4 and 5.

FIG. 6 illustrates a perspective view of the sheet feeding apparatus 200. When the shaft 201 rotates in the direction of the arrow B, the clutch unit 210 blocks the driving force from the shaft 201 to the rotation member 220. Accordingly, the pickup roller 250 contacts the sheet S on the tray 110 as shown in FIG. 7. In this case, as the relay gear 240 rotates in the direction of the arrow A, the stopper 260 elevates to open the sheet feeding path. When the driving force is transmitted from the shaft 201 to the feeding roller 230, the feeding roller 230 rotates in the direction of the arrow B by the saw tooth member 232, which engages the step surface 230*a*. Consequently, the pickup roller 250 connected to the feeding roller 230 by the relay gear 240 rotates in the direction of the arrow B to introduce the sheet S into the printing device 100. In this case, a step portion 120 is formed between the pickup roller 250 and the feeding roller 230, as the front end of the sheet S needs to pass over the step portion 120. Therefore, since the sheet S picked up by the pickup roller 250 contacts and passes over the step portion 120 to be held by the feeding roller 230, only the uppermost sheet S can pass over the step portion 120. This constitution of the sheet feeding apparatus 200 is efficient in preventing a plurality of sheets S from being introduced into the sheet feeding apparatus 200 at the same time.

A sensor 150 of FIG. 3 is installed in the printing apparatus 100 to detect whether there are no sheets S remaining in the tray 110. When the sheets S are exhausted, the driving source 130 rotates the shaft 201 in the direction of the arrow A. Then, the driving member 211, the spring clutch 212, and the bushing 213 of the clutch unit 210 rotate by the friction to rotate the rotation member 220, which is coupled to the coupling member 214, with respect to the shaft 201. Consequently, the pickup roller 250 is raised from the tray 110, and the feeding roller 230 and the pickup roller 250 do not rotate as shown in FIG. 8. In this case, the stopper 260 located between the pickup roller 250 and the feeding roller 230 is lowered in accordance to the rotation of the relay gear 240 in the direction of the arrow B to prevent the sheets S from entering under the feeding roller 230. By loading the sheets S on the tray 110 and pushing the sheets S toward the feeding roller 230, the front ends of the sheets S reach the stopper 260 to be aligned. Then, the rotation member 220 rotates as shown in FIG. 7 to continue a sheet feeding process. The sheet feeding apparatus 200 includes a stop projection 141 arranged in the cover 140 to prevent the rotation member 220 from rotating more than necessary.

According to the above-described constitution, when the sheets S on the tray 110 are exhausted, the pickup roller 250 is raised to allow the sheets S to be loaded on the tray 110 and then lowered after the sheets S are loaded. Consequently, the front ends of the sheets S are automatically inserted under the pickup roller 250. Therefore, it is possible to decrease an inclination of the tray 110 and reduce a height of the printing device 100, and the stack of the sheets S as high as a distance by which the pickup roller 250 is raised, may be loaded on the tray 110 at one time. In addition, since the front ends of the sheets S picked up by the pickup roller 250 contact and pass over the step portion 120 to be held by the feeding roller 230, only an uppermost sheet S can be held by the feeding roller 230. Accordingly, a plurality of the sheets S are prevented from being fed at once. Moreover, since the sheets S are aligned under the pickup roller 250 by the stopper 260 when the user pushes the sheets S between the tray 110 and the pickup roller 250, the front ends of the upper portion of the stack of the sheets S are prevented from being crumpled by the feeding roller 230.

The effects of the sheet feeding apparatus for the printing device according to the present invention are as follows.

First, since the pickup roller is raised to to allow the sheets to be loaded on the tray and then lowered after the sheets are loaded on the tray, the front ends of the sheets are automatically inserted under the pickup roller even when the inclination of the tray is not steep.

Second, since the step portion is arranged between the pickup roller and the feeding roller for only the uppermost sheet to pass over the step portion, a plurality of sheets are prevented from being fed at once.

Third, since the stopper aligns the sheets under the pickup roller when the user pushes the sheets toward the feeding roller, the front ends of the sheets are prevented from being crumpled by the feeding roller.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A sheet feeding apparatus for a printing device having a tray and a sheet feeding path, comprising:

a pickup roller picking up a sheet loaded on the tray to feed the sheet into the sheet feeding path;

a feeding roller receiving the sheet picked up by the pickup roller to introduce the sheet into the sheet feeding path;

a rotation shaft connected to a rotation power source to rotate the feeding roller;

a rotation member installed on the rotation shaft to support the pickup roller disposed at a free end of the rotation member and to rotate with respect to the rotation shaft;

a relay gear installed in the rotation member to engage the feeding roller and the pickup roller;

a clutch unit selectively transferring a rotation force of the rotation shaft to the rotation member by blocking the rotation force between the rotation member and the rotation shaft, so that the pickup roller contacts the sheet on the tray by a weight of the pickup roller when the rotation shaft rotates in a sheet feeding direction, and by transmitting the rotation force between the rotation shaft and the rotation member to rotate the rotation member according to a rotation of the rotation shaft when the rotation shaft rotates in an opposite direction opposite to the sheet feeding direction; and a stopper installed in the rotation member to be elevated and lowered with respect to the tray according to a rotation of the rotation member to locate a front end of the sheet loaded on the tray to be disposed under the pickup roller and not to reach the feeding roller by blocking a path between the pickup roller and the feeding roller, the stopper including a gear portion.

2. The sheet feeding apparatus of claim 1, wherein the gear portion abuts the relay gear to elevate and lower the stopper according to a rotation of the relay gear.

3. The sheet feeding apparatus of claim 1, wherein the rotation member comprises:

an elastic member installed on the tray to elastically support a lower portion of the stopper when the stopper is lowered.

4. The sheet feeding apparatus of claim 1, wherein the clutch unit comprises:

a coupling member coupled to the rotation member;

a bushing, into which an external circumference of the coupling member is inserted;

a spring clutch containing one end coupled to the bushing and the other end coupled to the coupling member while an external circumference of the spring clutch contacts an inner circumference of the bushing; and a driving member fixed on the rotation shaft to contact an inner circumference of the spring clutch.

5. The sheet feeding apparatus of claim 1, further comprising:

a step portion arranged between the pickup roller and the feeding roller so that the front end of the sheet picked up by the pickup roller contacts and passes over the step portion in a direction toward the feeding roller.

6. A sheet feeding apparatus for a printing device having a tray and a sheet feeding path, comprising:

a pickup roller picking up a sheet loaded on the tray to feed the sheet into the sheet feeding path;

a feeding roller receiving the sheet picked up by the pickup roller to introduce the sheet into the sheet feeding path;

a rotation shaft connected to a rotation power source to rotate the feeding roller;

a rotation member installed on the rotation shaft to support the pickup roller disposed at a free end of the rotation member and to rotate with respect to the rotation shaft;

a relay gear installed in the rotation member to engage the feeding roller and the pickup roller;

a clutch unit selectively transferring a rotation force of the rotation shaft to the rotation member by blocking the rotation force between the rotation member and the rotation shaft, so that the pickup roller contacts the sheet on the tray by a weight of the pickup roller when the rotation shaft rotates in a sheet feeding direction, and by transmitting the rotation force between the rotation shaft and the rotation member to rotate the rotation member according to a rotation of the rotation shaft when the rotation shaft rotates in an opposite direction opposite to the sheet feeding direction;

a stopper installed in the rotation member to be elevated and lowered with respect to the tray according to a rotation of the rotation member to locate a front end of the sheet loaded on the tray to be disposed under the pickup roller and not to reach the feeding roller by blocking a path between the pickup roller and the feeding roller; and a driving force connection unit selectively rotating the feeding roller according to the rotation of the rotation shaft, wherein the driving force connection unit includes:

a gear portion fixed on the rotation shaft;

a step surface of a pinwheel shape formed on one sectional surface of the feeding roller; and a saw tooth member installed between the step surface and the gear portion to rotate by the gear portion, having a saw tooth portion formed on one side of the saw tooth member so that the saw tooth portion engages the step surface only when the saw tooth member rotates in a certain direction.

7. The sheet feeding apparatus of claim 6, wherein the gear portion comprises an interference projection, and the saw tooth member comprises:

an interference piece engaging the interference projection to rotate the saw tooth member in response to the rotation of the rotation shaft.

8. The sheet feeding apparatus of claim 7, wherein the saw tooth portion comprises a first inclined portion and a first perpendicular portion, and the step surface comprises:

a second inclined portion and a second perpendicular portion, the rotation of the rotation shaft transmitted to the feeding roller through the gear portion, the saw tooth member, and the step surface when the first perpendicular portion of the saw tooth portion contacts the second perpendicular portion of the step surface.

9. The sheet feeding apparatus of claim 8, wherein the rotation of the rotation shaft is not transmitted to the feeding roller through the gear portion, the saw tooth member, and the step surface when the first inclined portion of the saw tooth portion contacts the second inclined portion of the step surface.

10. A sheet feeding apparatus for a printing device having a tray and a sheet feeding path, comprising:

a pickup roller picking up a sheet loaded on the tray to feed the sheet into the sheet feeding path;

a feeding roller feeding the picked-up sheet into the sheet feeding path;

a rotation shaft connected to a rotation power source;

a rotation member supporting the pickup roller and the feeding roller and having a stopper disposed therein, the stopper having a gear portion and being elevated and lowered with respect to the tray according to a rotation of the rotation member;

a clutch unit selectively transmitting a rotation of the rotation shaft to the rotation member to control the rotation member to rotate with respect to the rotation shaft; and a driving force connection unit selectively transmitting a driving force of the rotation shaft to the feeding roller and the pickup roller.

11. The sheet feeding apparatus of claim 10, wherein the rotation shaft comprises a first end and a second end, and the clutch unit is disposed between the first end of the rotation shaft and the rotation member while the driving force connection unit is disposed between the second end of the rotation member and the feeding roller.

12. The sheet feeding apparatus of claim 10, wherein the rotation of the rotation shaft is opposite to the driving force of the rotation shaft.

13. The sheet feeding apparatus of claim 10, wherein the rotation member comprises:

a relay gear connected between the feeding roller and the pickup roller to transmit a rotation of the feeding roller to the pickup roller.

14. The sheet feeding apparatus of claim 10, wherein the driving force connection unit transmits the driving force from the rotation shaft to the feeding roller when the clutch unit does not transmit the rotation of the rotation shaft to the rotation member.

15. The sheet feeding apparatus of claim 10, wherein the driving force connection unit does not transmit the driving force from the rotation shaft to the feeding roller when the clutch unit transmits the rotation of the rotation shaft to the rotation member.

16. The sheet feeding apparatus of claim 10, wherein the rotation member rotates in a first direction to move the pickup roller toward the tray when the clutch unit does not transmit the rotation of the rotation shaft to the rotation member, and in a second direction to move the pickup roller away from the tray when the clutch unit transmits the rotation of the rotation shaft to the rotation member.

17. The sheet feeding apparatus of claim 10, wherein the rotation member rotates by a weight of the rotation member about the rotation shaft in a direction to allow the pickup roller to contact the sheet loaded on the tray when the clutch unit does not transmit the rotation of the rotation shaft to the rotation member and when the driving force is transmitted from the rotation shaft to the feeding roller and the pickup roller.

18. The sheet feeding apparatus of claim 10, wherein the rotation member rotates by the rotation of the rotation shaft in a direction to move the pickup roller away from the tray when the clutch unit transmits the rotation of the rotation shaft to the rotation member and when the driving force is not transmitted from the rotation shaft to the feeding roller and the pickup roller.

19. The sheet feeding apparatus of claim 10, wherein the stopper moves in a first direction to block a path between the pickup roller and the feeding roller and in a second direction not to block the path.

20. The sheet feeding apparatus of claim 19, wherein the stopper allows the sheet loaded on the tray to be fed by the pickup roller toward the feeding roller when the stopper moves in the second direction.

21. The sheet feeding apparatus of claim 19, wherein the stopper does not allow the sheet loaded on the tray to move toward the feeding roller when the stopper moves in the first direction rotation.

22. The sheet feeding apparatus of claim 19, wherein the stopper moves in the first direction when the rotation of the rotation shaft is transmitted to the rotation member and when the driving force of the rotation shaft is not transmitted to the feeding roller and the pickup roller.

23. The sheet feeding apparatus of claim 19, wherein the stopper moves in the second direction when the rotation of the rotation shaft is not transmitted to the rotation member and when the driving force of the rotation shaft is transmitted to the feeding roller and the pickup roller.

24. The sheet feeding apparatus of claim 19, wherein the sheet loaded on the tray is disposed under the pickup roller and arranged to contact the stopper when the stopper moves in the first direction when the rotation member moves in response to the rotation of the rotation shaft.

25. A method in a sheet feeding apparatus for a printing device having a tray, a pickup roller picking up a sheet loaded on the tray to feed the sheet into a sheet feeding path, and a feeding roller feeding the picked-up sheet into the sheet feeding path, the method comprising;

inserting a rotation shaft connected to a rotation power source into a hole formed along a longitudinal center of the feeding roller;

supporting the pickup roller and the feeding roller using a rotation member rotatably mounted on the rotation shaft, the rotation member including a stopper disposed therein, the stopper having a gear portion and being elevated and lowered with respect to the tray according to rotation of the rotation member;

selectively transmitting a rotation of the rotation shaft to the rotation member to control the rotation member to rotate with respect to the rotation shaft; and selectively transmitting a driving force of the rotation shaft to the feeding roller and the pickup roller.

26. The method of claim 25, wherein the selectively transmitting of the rotation and the driving force of the rotation shaft comprises:

transmitting the rotation of the rotation shaft to the rotation member when the driving force is not transmitted to the feeding roller and the pickup roller; and transmitting the driving force of the rotation shaft to the feeding roller and the pickup roller when the rotation of the rotation shaft is not transmitted to the rotation member.

27. The method of claim 25, wherein the supporting of the pickup roller and the feeding roller comprises:

blocking a path of the sheet between the pickup roller and the feeding roller when the rotation of the rotation shaft is transmitted to the rotation member; and allowing the picked-up sheet to pass through the path of the sheet when the rotation of the rotation shaft is not transmitted to the rotation member and when the driving force of the rotation shaft is transmitted to the feeding roller and the pickup roller.

* * * * *